US006945763B2

(12) United States Patent
Bodzak et al.

(10) Patent No.: US 6,945,763 B2
(45) Date of Patent: Sep. 20, 2005

(54) GEARED PUMP WITH FORCED LUBRICATED COUPLING

(75) Inventors: Stanislaw Bodzak, Elsbethen (AT); Theodor Stipek, Salzburg (AT); Robert Reitsam, Salzburg (AT)

(73) Assignee: Robert Bosch GmbH, Stuttgart (DE)

( * ) Notice: Subject to any disclaimer, the term of this patent is extended or adjusted under 35 U.S.C. 154(b) by 200 days.

(21) Appl. No.: 10/296,002

(22) PCT Filed: Mar. 27, 2001

(86) PCT No.: PCT/DE01/01166

§ 371 (c)(1),
(2), (4) Date: Jun. 2, 2003

(87) PCT Pub. No.: WO02/077460

PCT Pub. Date: Oct. 3, 2002

(65) Prior Publication Data

US 2003/0180160 A1 Sep. 25, 2003

(51) Int. Cl.[7] ..... F01C 21/04; F01C 1/18; F04B 17/00; F04B 23/00

(52) U.S. Cl. ..... 418/102; 418/206.8; 417/410.4; 417/440

(58) Field of Search ..... 418/102, 206.8; 417/410.4, 441, 440

(56) References Cited

U.S. PATENT DOCUMENTS 3,063,378 A * 11/1962 Hart ..... 418/79
3,170,409 A * 2/1965 McLeod et al. ..... 418/1
3,306,225 A * 2/1967 Smith ..... 418/131
4,501,536 A * 2/1985 Middlekauff ..... 418/61.3
4,770,617 A * 9/1988 Hertell ..... 418/77
5,167,496 A * 12/1992 Jacobsson et al. ..... 418/102
6,071,105 A * 6/2000 Bodzak et al. ..... 418/102
6,123,531 A * 9/2000 Blume et al. ..... 418/102

FOREIGN PATENT DOCUMENTS

DE 196 38 332 A1 * 3/1998 ..... F04C/2/14
DE 199 422 221 A1 * 3/2001 ..... F04C/2/344
GB 2 056 567 * 3/1981 ..... F04C/2/14
JP 09-4570 * 7/1997 ..... F04C/2/10

* cited by examiner

*Primary Examiner*—Justine R. Yu
*Assistant Examiner*—Timothy P. Solak
(74) *Attorney, Agent, or Firm*—Ronald E. Greigg

(57) ABSTRACT

A geared feed pump has a housing having a pump chamber in which a rotationally driven pair of gear wheels meshing with one another is disposed for pumping medium out of a suction chamber that communicates with a supply tank, along feed conduits, formed between the circumferential surface of the gear wheels and the circumferential walls of the pump chamber, into a pressure chamber. A drive shaft connected with one of the gear wheels via a coupling member is disposed inside the housing in a coupling chamber. The coupling chamber has a connection with the pressure chamber, so that lubrication of the coupling member is effected by the pumping medium.

17 Claims, 4 Drawing Sheets

GEARED PUMP WITH FORCED LUBRICATED COUPLING

CROSS-REFERENCE TO RELATED APPLICATIONS

This application is a 35 USC 371 application of PCT/DE 01/01166 filed on Mar. 27, 2001.

BACKGROUND OF THE INVENTION

1. Field of the Invention

The invention is directed to an improved geared feed pump particularly useful in conjunction with a fuel injection system of an internal combustion engine.

2. Description of the Prior Art

One geared feed pump of the type with which this invention is concerned is known from German Patent Disclosure DE 19638332 A1. This geared feed pump has a housing in which a pump chamber is formed, in which chamber a rotationally driven pair of gear wheels meshing with one another is disposed, which gear wheels pump a pumping medium out of a suction chamber that communicates with a supply tank, along feed conduits, formed between the circumferential surface of the gear wheels and the circumferential walls of the pump chamber, into a pressure chamber. The geared feed pump furthermore has a drive shaft, which is connected in a rotationally engaged manner with one of the gear wheels via a coupling member disposed inside the housing in a coupling chamber. The coupling member has no lubrication and under some circumstances is therefore subject to severe wear.

SUMMARY OF THE INVENTION

The geared feed pump of the invention has the advantage over the prior art that lubrication of the coupling member is accomplished by the pumping medium, and wear is thus reduced.

Various embodiments and advantageous features and refinements of the geared feed pump of the invention are disclosed. One embodiment assures that only a slight portion of the quantity pumped by the geared feed pump is diverted to the coupling chamber for lubrication. Another refinement assures that the quantity pumped by the geared feed pump is not reduced when the pumping is started, and that none of the pumped quantity is diverted into the coupling chamber for lubrication until an adequate pumping pressure is achieved. Other embodiments make a simple embodiment of the pressure valve possible.

BRIEF DESCRIPTION OF THE DRAWINGS

Three exemplary embodiments of the invention are described in further detail in the ensuing description, taken in conjunction with the drawings, in which.

DESCRIPTION OF THE PREFERRED EMBODIMENTS

Figure 1:
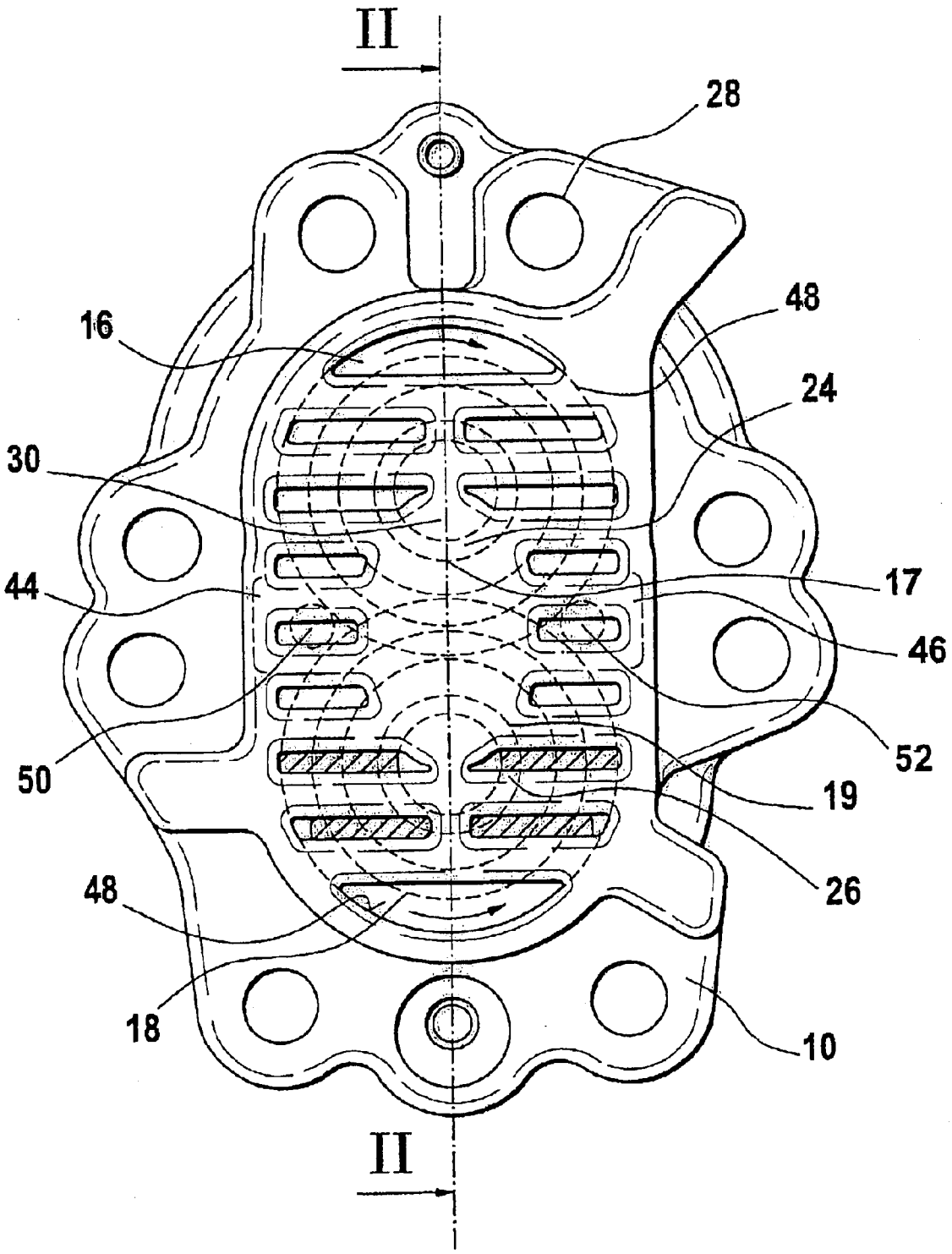
FIG. 1 shows a geared feed pump in a plan view in the direction of the arrow I in FIG. 2.

A geared feed pump shown in FIGS. 1–4 is disposed in a supply line, not shown, from a supply tank to a fuel injection pump of an internal combustion engine. The engine is a self-igniting internal combustion engine, and the fuel pumped by the geared feed pump is Diesel fuel. The geared feed pump has a housing, which comprises a housing part 10 and a cap part 12. Between the housing part 10 and the cap part 12, a pump chamber 14 is formed, in which a pair of meshing gear wheels 16, 18 is disposed. For forming the pump chamber 14, the housing part 10 has two indentations 20, 22, from the bottom of each of which a respective bearing journal 24, 26 projects. The bearing journals 24, 26 are embodied integrally with the housing part 10 and extend approximately parallel to one another. The gear wheel 16 has a bore 17, by way of which it is rotatably supported on the bearing journal 24. The gear wheel 18 has a bore 19, by way of which it is rotatably supported on the bearing journal 26. The cap part 12 rests on the face end of the housing part 10 and is solidly joined to the housing part 10, for instance by means of a plurality of screws, which pass through bores 28. The gear wheels 16, 18 are fixed between the cap part 12 and the bottom of the indentations 20, 22 in the direction of their longitudinal axes. The bearing journals 24, 26 may be embodied in hollow fashion.

The geared feed pump moreover has a drive shaft 30, which is rotatably supported in the housing part 10 and/or in the cap part 12. The drive shaft 30 is disposed at least approximately coaxially to the bearing journal 24, and the bearing journal 24 has a blind bore 32 into which the end of the drive shaft 30 protrudes. The cap part 12 has a bore 34 through which the drive shaft 30 passes, and a shaft sealing ring 36 is built in between the bore 34 and the drive shaft 30 in order to seal off the housing. A sealing ring 38 is also built in between the housing part 10 and the cap part 12.

The bearing journal 24 ends with an axial spacing from the cap part 12, and a coupling member 40 disposed between the face end of the bearing journal 24 and the cap part 12 is joined to the drive shaft 30. The coupling member 40 is connected by positive engagement in the direction of rotation to the drive shaft 30. The connection of the coupling member 40 to the drive shaft 30 can be made for instance by means of a non-circular cross section of the drive shaft 30, which can be accomplished for instance by means of one or more flat faces on the circumference of the drive shaft 30. The coupling member 40 has an opening with a correspondingly shaped cross section. In the gear wheel 16, which is supported on the bearing journal 24, its bore 17 is embodied in the axial direction approximately at the revel of the bearing journal 24. Toward its side toward the cap part 12, the gear wheel 16 has an opening 42, which is embodied as noncircular in cross section and which is engaged by the coupling member 40. The outside cross section of the coupling member 40 and the inside cross section of the opening 42 are complementary to one another in such a way that there is a connection in a rotationally engaged manner between the coupling member 40 and the gear wheel 16. For example, the cross sections of the coupling member 40 and of the opening 42 may be polygonal, or they may have radial protrusions and corresponding radial recesses that are engaged by the protrusions. The region in the axial extension between the bearing journal 24 and the cap part 12, in which cap part the coupling member 40 is disposed, forms a coupling chamber 41 which communicates with the blind bore 32.

In operation of the geared feed pump, the gear wheel 16 is driven to rotate via the drive shaft 30 and transmits this rotary motion, via a spur gear, to the gear wheel 18 which meshes with the gear wheel 16 and is likewise provided with a spur gear. The gear wheels 16, 18, by the meshing of their teeth, divide the pump chamber 14 into two portions, of which a first portion forms a suction chamber 44 and a second portion forms a pressure chamber 46. The suction chamber 44 communicates with the pressure chamber 46 via one feed conduit 48 each, formed between the tooth slots on the circumferential surfaces of the gear wheels 16, 18 and the upper and lower circumferential walls of the pump chamber 14. The suction chamber 44 and the pressure chamber 46 each have one connection opening in the wall of the housing part 10 or of the cap part 12, by way of which opening the suction chamber 44 communicates with a suction line, not shown, from the supply tank, and the pressure chamber 46 communicates, via a feed line, also not shown, with the suction chamber of the fuel injection pump. The connection opening into the suction chamber 44 forms an inlet opening 50, and the connection opening into the pressure chamber 46 forms an outlet opening 52.

Figure 2:
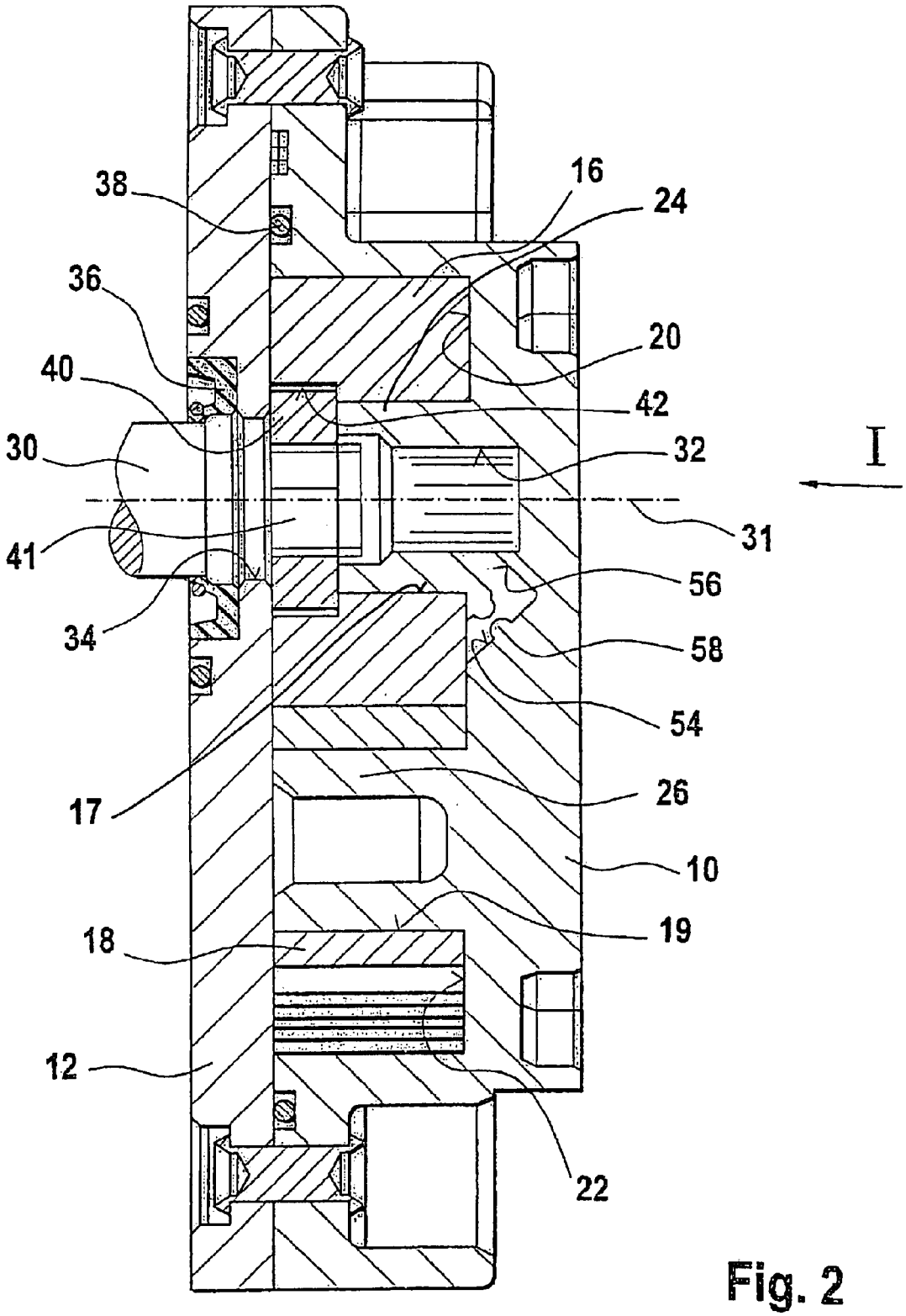
FIG. 2 shows the geared feed pump in a first exemplary embodiment in a longitudinal section taken along the line II—II in FIG. 1.

In FIG. 2, the geared feed pump is shown in a first exemplary embodiment. The coupling chamber 41 in which the coupling member 40 is disposed has a connection with the pressure chamber 46. To that end, a bore segment 54 is made in the housing part 10, leading away from the pressure chamber 46 and extending in inclined fashion to the longitudinal axis 31 of the drive shaft 30 and of the blind bore 32 in such a way that the bore segment 54 approaches closer to the longitudinal axis 31 as the spacing from the cap part 12 increases. A further bore segment 56 is made in the housing part 10; it originates at the bore segment 54 and discharges into the blind bore 32. The bore segment 56 extends at an incline to the longitudinal axis 31 of the drive shaft 30 and of the blind bore 32 such that the bore segment 56 comes closer to the longitudinal axis 31 toward the cap part 12. The bore segments 54, 56 can extend perpendicular to one another, for instance. Thus the coupling chamber 41 communicates with the pressure chamber 46 via the blind bore 32 and the bore segments 54, 56. A throttle restriction 58 of reduced cross section can be made in one of the bore segments 54, 56, in order to limit the flow rate. Alternatively, one or both bore segments 54, 56 can be embodied with such a small cross section that a throttling action exists and the flow rate is limited.

The geared feed pump of the invention functions as follows. In operation of the geared feed pump, the drive shaft 30 is driven preferably in proportion to the rpm of the internal combustion engine to be supplied. The drive shaft 30 transmits the rotary motion via the coupling member 40 to the gear wheel 16, which in turn drives the gear wheel 18 meshing with it to rotate. As a result of the rotary motion of the meshing gear wheels 16, 18, the fuel is pumped out of the suction chamber 44 along the feed conduits 48 into the pressure chamber 46. This creates a negative pressure in the suction chamber 44 that is sufficient to aspirate further fuel from the supply tank via the suction line. The fuel pressure built up in the pressure chamber 46 brings about fuel pumping via the outlet opening 52 into the supply line to the fuel injection pump.

From the pressure chamber 46, fuel under pressure flows through the bore segments 54, 56 into the blind bore 32 and from it into the coupling chamber 41. By means of the fuel, lubrication of the coupling member 40 in the coupling chamber 41 is attained; both the contact points between the coupling member 40 and the drive shaft 30 and the contact points between the coupling member 40 and the gear wheel 16 are lubricated. Diesel fuel has a viscosity that enables lubrication. The throttle restriction 58 into the bore segment 54, 56, or their embodiment with a small cross section, assures that only a slight quantity of fuel for lubrication is diverted from the pressure chamber 46 into the coupling chamber 41, correspondingly reducing the pumping quantity of the geared pump. The coupling chamber 41 can additionally have a connection with the suction chamber 44, through which connection fuel can flow out of the coupling chamber 41 back into the suction chamber 44.

Figure 3:
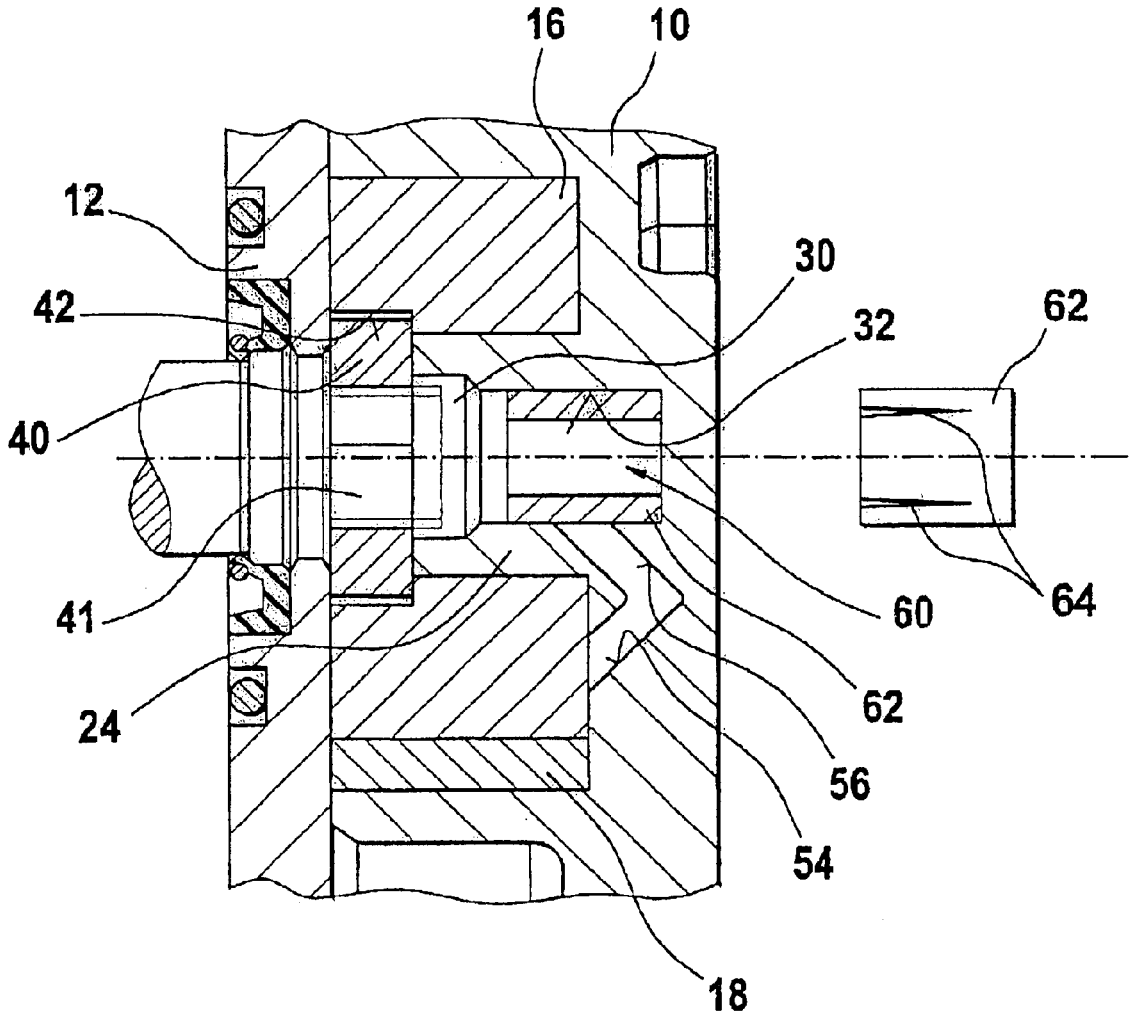
FIG. 3 is a fragmentary longitudinal section through the geared feed pump in a second exemplary embodiment.

In FIG. 3, the geared feed pump is shown in a second exemplary embodiment, in which the fundamental structure is the same as described above for the first exemplary embodiment. In addition, a pressure valve 60 is provided, by which the connection of the coupling chamber 41 with the pressure chamber 46 is controlled as a function of the pressure in the pressure chamber 46. The pressure valve 60 does not open the connection of the coupling chamber 41 with the pressure chamber 46 until a predetermined opening pressure in the pressure chamber 46 is exceeded. In the second exemplary embodiment, the pressure valve 60 has a sleeve 62, which is inserted into the blind bore 32 and is embodied radially resiliently. The sleeve 62 can comprise metal or plastic. To achieve the radially resilient embodiment of the sleeve 62, this sleeve preferably has one or more longitudinal slits 64. The longitudinal slits begin at the face end of the sleeve 62 oriented toward the drive shaft 30 and extend over part of the length of the sleeve 62 toward the bottom of the blind bore 32. The bore segment 56 discharges into the blind bore 32 in a region where the longitudinal slits 64 are embodied in the sleeve 62. In its outset state, the sleeve 62 is resiliently radially braced in the blind bore 32, so that it closes the orifice of the bore segment 56 into the blind bore 32. When the pressure in the pressure chamber 46 rises, the sleeve 62 is resiliently radially compressed as a consequence of the pressure acting on it via the orifice of the bore segment 56, so that the sleeve uncovers the orifice of the bore segment 56, and fuel can flow into the blind bore 32 and the coupling chamber 41. Upon starting of the geared feed pump, the full feed pressure is not yet generated by the pump, because of the low rpm, and so the sleeve 62 closes the orifice of the bore segment 56, and no fuel is diverted from the pressure chamber 46 for lubrication in the coupling chamber 41; instead, the entire pumping quantity is pumped to the fuel injection pump. Not until the opening pressure in the pressure chamber 46 is reached does the sleeve 62 uncover the orifice of the bore segment 56, allowing fuel for lubrication to reach the coupling chamber 41. The opening pressure in the pressure chamber at which the pressure valve 60 opens can amount for instance to approximately 2 bar. For limiting the flow rate when the pressure valve 60 is open, as in the first exemplary embodiment, a throttle restriction 58 can be provided in the bore segments 54, 56, or their cross section can be made correspondingly small.

Figure 4:
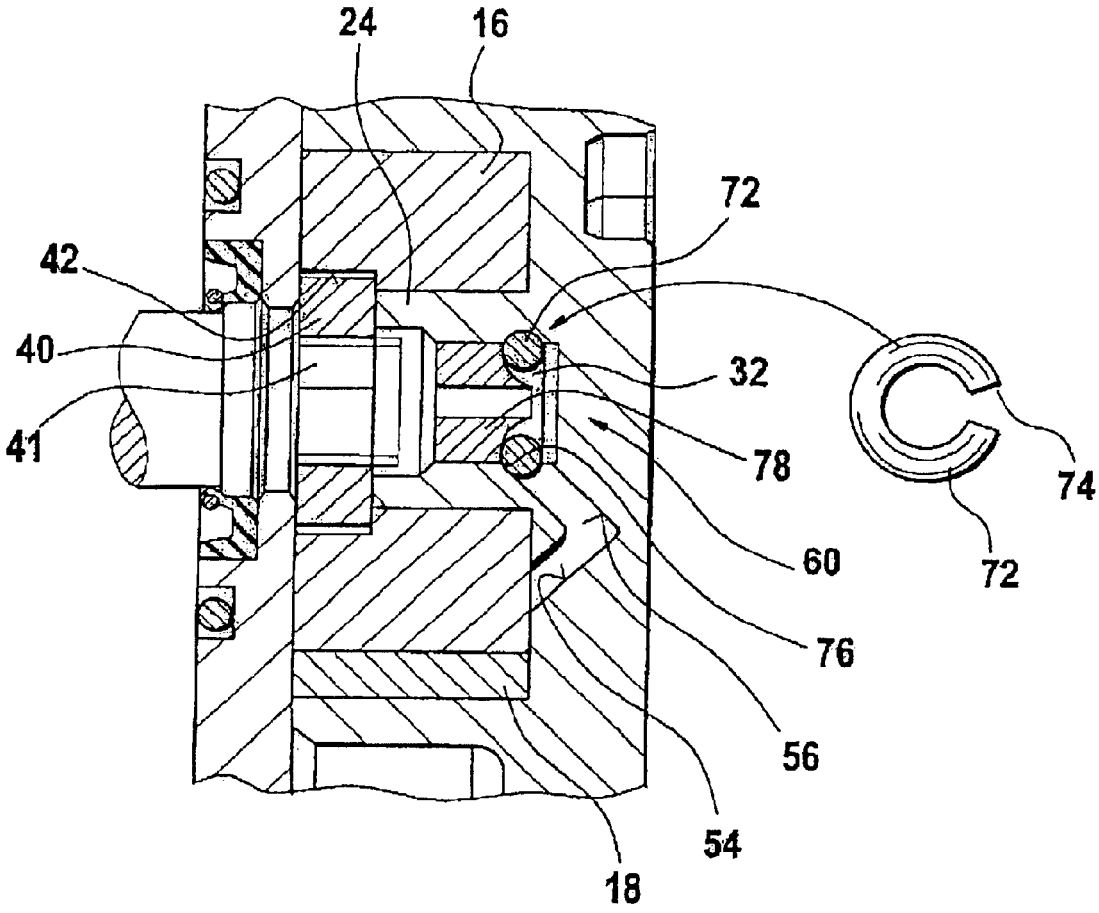
FIG. 4 is a fragmentary longitudinal section through the geared feed pump of a third exemplary embodiment.

In FIG. 4, the geared feed pump is shown in a third exemplary embodiment, in which once again the fundamental structure is the same as in the first and second exemplary embodiments, but the embodiment of the pressure valve 60 is modified. The pressure valve 60 has a radially resilient ring 72, which is placed with prestressing in an annular groove 76 embodied in the blind bore 32. The ring 72 may be made from a wire of round cross section, and the annular groove 76 correspondingly also has an adapted round cross section, so that the ring 72 rests over a large surface area in the annular groove 76. The ring 72 preferably comprises steel, and to achieve the radially resilient property it has a longitudinal slit 74. The bore segment 56 discharges into the annular groove 76, and the longitudinal slit 74 in the ring 72 is offset from the bore segment 56 in the circumferential direction. A sleeve 78 can also be press-fitted into the blind bore 32; the sleeve serves to secure the ring 72 in the direction of the longitudinal axis 31, so that the ring cannot escape from the annular groove 76 and be moved in the blind bore 32 toward the drive shaft 30. When the fuel pressure in the pressure chamber 46 is low, the ring 72, because of its prestressing, rests on the circumference of the annular groove 76 and closes the orifice of the bore segment 56. Once the fuel pressure in the pressure chamber 46 exceeds the opening pressure, the ring 72 is resiliently compressed, so that it uncovers the orifice of the bore segment 56, and fuel reaches the blind bore 32 and from it, through the sleeve 78, the coupling chamber 41.

The foregoing relates to preferred exemplary embodiment of the invention, it being understood that other variants and embodiments thereof are possible within the spirit and scope of the invention, the latter being defined by the appended claims.

What is claimed is:

1. A geared feed pump, comprising a housing (10, 12) in which a pump chamber (14) is formed, a rotationally driven pair of gear wheels (16, 18) meshing with one another disposed in the pump chamber (14) which gear wheels pump a pumping medium out of a suction chamber (44) along feed conduits (48), formed between the circumferential surface of the gear wheels (16, 18) and the circumferential walls of the pump chamber (14), into a pressure chamber (46), and a drive shaft (30) which is connected in a rotationally engaged manner with one of the gear wheels (16) via a coupling member (40) disposed inside the housing (10, 11) in a coupling chamber (41), and a connection (32, 54, 56) communicating the coupling chamber (41) with the pressure chamber (46), further comprising a pressure valve (60) disposed in the connection (32, 54, 56) communicating the coupling chamber (41) with the pressure chamber (46), which pressure valve keeps the connection closed until a predetermined opening pressure in the pressure chamber (46) is exceeded, wherein the pressure valve (60) comprising a radially resilient sleeve (62) fastened in a bore (32) of a housing part (10), and a connecting bore (56) to the pressure chamber (46) discharging into the bore (32) at the jacket of the sleeve (62).

2. The geared feed pump of claim 1, wherein the sleeve (62) has at least one longitudinal slit (64).

3. The geared feed pump of claim 2, wherein the bore (32) is a blind bore, into which one end of the drive shaft (30) protrudes.

4. The geared feed pump of claim 1, wherein the bore (32) is a blind bore, into which one end of the drive shaft (30) protrudes.

5. A geared feed pump, comprising a housing (10, 12) in which a pump chamber (14) is formed, a rotationally driven pair of gear wheels (16, 18) meshing with one another disposed in the pump chamber (14) which gear wheels pump a pumping medium out of a suction chamber (44) along feed conduits (48), formed between the circumferential surface of the gear wheels (16, 18) and the circumferential walls of the pump chamber (14), into a pressure chamber (46), and a drive shaft (30) which is connected in a rotationally engaged manner with one of the wheels (16) via a coupling member (40) disposed inside the housing (10, 11) in a coupling chamber (41), and a connection (32, 54, 56) communicating the coupling chamber (41) with the pressure chamber (46), wherein the connection (32, 54, 56) communicating the coupling chamber (41) with the pressure chamber (46) comprises at least one throttle restriction (58), further comprising a pressure valve (60) disposed in the connection (32, 54, 56) communicating of the coupling chamber (41) with the pressure chamber (46), which pressure valve keeps the connection closed until a predetermined opening pressure in the pressure chamber (46) is exceeded.

6. The geared feed pump of claim 5, wherein the pressure valve (60) comprising a radially resilient sleeve (62) fastened in a bore (32) of a housing part (10), and a connecting bore (56) to the pressure chamber (46) discharging into the bore (32) at the jacket of the sleeve (62).

7. The geared feed pump of claim 6, wherein the sleeve (62) has at least one longitudinal slit (64).

8. The geared feed pump of claim 7, wherein the bore (32) is a blind bore, into which one end of the drive shaft (30) protrudes.

9. The geared feed pump of claim 6, wherein the bore (32) is a blind bore, into which one end of the drive shaft (30) protrudes.

10. The geared feed pump of claim 5, wherein the pressure valve (60) comprises a radially resilient ring (72) that is fastened in an annular groove (76) in a bore (32) of a housing part (10), and a connecting bore (56) to the pressure chamber (46) discharging into the annular groove (76).

11. The geared feed pump of claim 10, further comprising a support element (78) inserted into the bore (32) and securing the element the ring (72) in the axial direction against escaping from the annular groove (76).

12. The geared feed pump of claim 11, wherein the bore (32) is a blind bore, into which one end of the drive shaft (30) protrudes.

13. The geared feed pump of claim 10, wherein the bore (32) is a blind bore, into which one end of the drive shaft (30) protrudes.

14. A geared feed pump, comprising a housing (10, 12) in which a pump chamber (14) is formed, a rotationally driven pair of gear wheels (16, 18) meshing with one another disposed in the pump chamber (14) which gear wheels pump a pumping medium out of a suction chamber (44) along feed conduits (48), formed between the circumferential surface of the gear wheels (16, 18) and the circumferential walls of the pump chamber (14), into a pressure chamber (46), and a drive shaft (30) which is connected in a rotationally engaged manner with one of the gear wheels (16) via a coupling member (40) disposed inside the housing (10, 11) in a coupling chamber (41), and a connection (32, 54, 56) communicating the coupling chamber (41) with the pressure chamber (46), further comprising a pressure valve (60) disposed in the connection (32, 54, 56) communicating the coupling chamber (41) with the pressure chamber (46), which pressure valve keeps the connection closed until a predetermined opening pressure in the pressure chamber (46) is exceeded, wherein the pressure valve (60) comprises a radially resilient ring (72) that is fastened in an annular groove (76) in a bore (32) of a housing part (10), and a connecting bore (56) to the pressure chamber (46) discharging into the annular groove (76).

15. The geared feed pump of claim 14, further comprising a support element (78) inserted into the bore (32) and securing the element the ring (72) in the axial direction against escaping from the annular groove (76).

16. The geared feed pump of claim 15, wherein the bore (32) is a blind bore, into which one end of the drive shaft (30) protrudes.

17. The geared feed pump of claim 14, wherein the bore (32) is a blind bore, into which one end of the drive shaft (30) protrudes.

* * * * *